United States Patent [19]

Schniederjan

[11] Patent Number: 4,518,321

[45] Date of Patent: May 21, 1985

[54] POWER REGULATION DEVICE FOR A HYDRAULIC PUMP

[75] Inventor: Reinhold Schniederjan, Neu-Ulm, Fed. Rep. of Germany

[73] Assignee: Hydromatik GmbH, Elchingen, Fed. Rep. of Germany

[21] Appl. No.: 524,557

[22] Filed: Aug. 19, 1983

[30] Foreign Application Priority Data

Sep. 2, 1982 [DE] Fed. Rep. of Germany ..... 3232695

[51] Int. Cl.[3] ..... F04B 49/00

[52] U.S. Cl. ..... 417/218; 60/452

[58] Field of Search ..... 91/445; 60/447, 452, 60/443, 444, 445; 417/217, 218, 222, 221, 220, 219

[56] References Cited

U.S. PATENT DOCUMENTS

| | | | |
|---|---|---|---|
| 3,635,021 | 1/1972 | McMillen et al. | 417/222 X |
| 3,935,707 | 2/1976 | Murphy et al. | 417/218 X |
| 4,107,924 | 8/1978 | Dezelan | 60/445 |
| 4,344,285 | 8/1982 | Ridge | 60/452 |
| 4,349,319 | 9/1982 | Byers, Jr. et al. | |
| 4,420,935 | 12/1983 | Kobald | 60/452 X |

FOREIGN PATENT DOCUMENTS

| | | | |
|---|---|---|---|
| 2038968 | 2/1972 | Fed. Rep. of Germany | 417/216 |
| 2513548 | 3/1975 | Fed. Rep. of Germany | |

*Primary Examiner*—Edward K. Look

*Attorney, Agent, or Firm*—Lewis H. Eslinger

[57] ABSTRACT

A power regulation device for a hydraulic pump includes a slidable piston having a first end face with a first diameter and a second, opposite end face with a smaller diameter, the second end face being biased by operating fluid pressure from the hydraulic pump and the first end face being biased by an adjustable fluid pressure for controlling the operation of the hydraulic pump; a compression spring which biases the piston in a direction against that of the adjustable fluid pressure; a measuring spring, one end of which biases the piston in the same direction as the compression spring; a power valve having a control slider member which is biased in one direction by the other end of the measuring spring and by the operating fluid pressure from the pump and in the opposite direction by a compression spring, the control slider member including a transverse channel for supplying the adjustable fluid pressure to the first end face of the piston during idling and normal operations and for connecting the adjustable fluid pressure at the first end face to a pressureless drain when the operating fluid pressure of the pump exceeds a first predetermined level; and a pilot valve including a control slider member biased in one direction by a spring and in the opposite direction by a fluid pressure, the control slider member of the pilot valve including a transverse channel for connecting the adjustable fluid pressure at the first end face of the piston to a pressureless drain during no-load and idling states of the hydraulic pump.

6 Claims, 3 Drawing Figures

POWER REGULATION DEVICE FOR A HYDRAULIC PUMP

BACKGROUND OF THE INVENTION

This invention relates generally to hydraulic pumps and, more particularly, is related to a power regulation device for a hydraulic pump.

A power regulation device is known, for example, from German Patent No. 2,038,968, which provides for simultaneous dependent control of several hydraulic pumps. The power regulation device is provided with an adjustable piston slidable within a cylinder arrangement such that operation of the hydraulic pumps is controlled by adjusting the position of the piston. In this regard, an adjustable fluid pressure acts against one end face of the piston, and a spring assembly, including a measuring spring, acts to bias the piston in the opposite direction against the force of the adjustable fluid pressure. A power valve is provided for controlling the adjustable fluid pressure and includes a control slider member having a valve arrangement which controls the adjustable fluid pressure in relation to the slidable position of the control slider member. In this regard, the control slider member is biased in a first direction by the measuring spring and in the opposite direction by operating fluid pressure of the hydraulic pump. It is to be appreciated that such power regulation device is also suitable for control of a single hydraulic pump.

Typically, and with the device of the aforementioned German patent, power or pressure regulated adjustable hydraulic pumps are initially adjusted by springs acting on the adjustable piston at maximum flow volume, that is, at a no-load condition. With increasing pressure of the operating fluid flowing through the hydraulic pump, the pump, for example, of the type previously described with respect to German Patent No. 2,038,968, provides for a smaller flow volume. However, this means that even when full flow volume of the hydraulic pump is not required, such as in the idling state of the pump, the hydraulic pump will normally supply maximum flow. This is particularly critical during the idling operation of the hydraulic pump when no power is consumed by a connected load, whereby substantial losses occur because of unnecessary pumping of the aforementioned maximum flow quantity to which the pump is set.

OBJECTS AND SUMMARY OF THE INVENTION

Accordingly, it is an object of this invention to provide a power regulation device for a hydraulic pump that avoids the above-described difficulties encountered with the previously known arrangement.

More particularly, it is an object of this invention to provide a power regulation device for a hydraulic pump which controls the hydraulic pump to a minimum flow operation during a no-load condition.

It is another object of this invention to provide a power regulation device for a hydraulic pump in which a pilot valve cuts off the adjusting pressure to the slidable piston during the no-load condition of the pump.

It is still another object of this invention to provide a power regulation device for a hydraulic pump which controls the pump to a decreasing flow operation when fluid pressure increases greater than a predetermined level.

It is yet another object of this invention to provide a power regulation device for a hydraulic pump in which operating fluid pressure and a measuring spring bias a power valve in the same direction, and a pilot valve associated with the power valve cuts off the adjusting pressure to the slidable piston during the no-load condition of the pump.

In accordance with an aspect of this invention, a power regulation device for a hydraulic pump comprises hydraulic adjustable means including slidable piston means biased in one direction by at least measuring spring means and in an opposite direction by an adjustable fluid pressure; power valve means including control slider means for controlling the adjustable pressure, power spring means for biasing the control slider means in one direction, and the measuring spring means and operating fluid pressure of the hydraulic pump biasing the control slider means in an opposite direction; and pilot valve means for cutting off the adjustable fluid pressure during a no-load state of the hydraulic pump.

The above, and other, objects, features and advantages of the present invention will become readily apparent from the following detailed description thereof which is to be read in connection with the accompanying drawings.

DETAILED DESCRIPTION OF THE PREFERRED EMBODIMENTS

Figure 1:
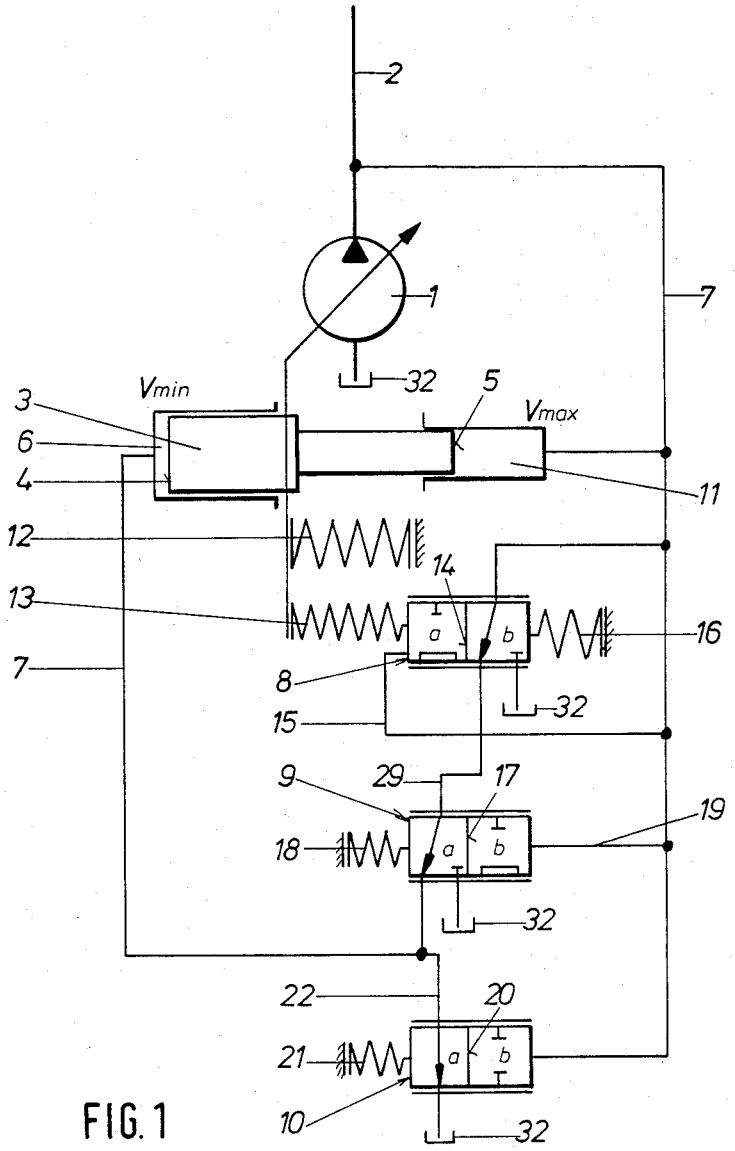
FIG. 1 is a schematic diagram of a power regulation device for a hydraulic pump according to a first embodiment of the present invention.

Referring to the drawings in detail, and initially to FIG. 1 thereof, a power regulation device according to a first embodiment of the present invention for use with a hydraulic pump 1 having an operating pipe 2 through which operating fluid pressure of the pump is provided includes a slidably adjustable piston 3 for controlling the discharge volume of hydraulic pump 1. Piston 3 is provided with a large piston end face 4 and a small piston end face 5 sealably and slidably positioned within respective cylindrical bores and which control the minimum and maximum discharge volume settings $V_{min}$ and $V_{max}$, respectively of pump 1. Large piston end face 4 is positioned within a cylindrical control space 6 in its respective cylindrical bore into which a control pipe 7 empties, the latter control pipe 7 being connected to operating pipe 2 of hydraulic pump 1 through a power valve 8 and a pressure valve 9 which control or adjust the fluid pressure in control pipe 7.

Smaller piston end face 5 is positioned within a cylindrical space 11 connected to control pipe 7 at the output side of hydraulic pump 1 before the connection of valves 8 and 9. It is to be noted that the operating fluid pressure in cylindrical space 11 functions only to support an adjustable spring 12 which biases piston 3 in a direction opposite to the biasing force of the adjustable fluid pressure in control space 6. A measuring spring 13 is also provided parallel to spring 12 and acts on piston 3 so as to bias the latter in the same direction as spring 12.

The power regulation device according to the present invention also includes a power valve 8 having a control slider member 14 slidably positioned within a respective cylindrical bore and which controls or adjusts the pressure within control space 6 through control pipe 7. More particularly, slider member 14 is biased in one direction by the opposite end of measuring spring 13, and also, by the operating fluid pressure of hydraulic pump 1 from control pipe 7 at the output of hydraulic pump 1 through a pipe 15. Slider member 14 is biased in the opposite direction by a power compression spring 16. It is to be appreciated that slider member 14 is provided with a transverse channel such that, when slider member 14 is slidably positioned at switch setting b thereof, as shown in FIG. 1, fluid from control pipe 7 is transmitted through slider member 14 to an output pipe 29. On the other hand, when slider member 14 is slideably positioned at switch setting a thereof, output pipe 29 is connected in fluid communication to a pressureless drain 32, and the fluid in control pipe 7 is prevented from passing to output pipe 29, as indicated by the inverted-T section shown in FIG. 1 for switch setting a. It is to be appreciated that such switch settings a and b are merely shown schematically and are not intended to demonstrate the actual slidable movement of slider member 14.

A pressure valve 9 is also provided and includes a slider member 17 slidably positioned within a respective cylindrical bore and which is biased therein in one direction by a spring 18 and in the opposite direction by fluid pressure in control pipe 7 through a pipe 19. When slider member 17 is slidably positioned at switch setting a thereof, as shown in FIG. 1, fluid from output pipe 29 of power valve 8 is transmitted through a transverse channel in slider member 17 to the output end of control pipe 7, and then to control space 6 as the adjustable fluid pressure for biasing piston 3. On the other hand, when slider member 17 is slidably positioned at switch setting b, fluid in output pipe 29 cannot pass through valve 9, as indicated by the inverted-T section shown in FIG. 1 for switch setting b thereof. Also, for switch setting b thereof, the output of valve 9 is connected to pressureless drain 32. Again, it is to be appreciated that switch settings a and b thereof are merely indicated as functional switch settings in the drawings and are not intended to demonstrate the actual slidable movement of slider member 17.

In accordance with the present invention, a pilot valve 10 is provided and includes a control slider member 20. In the embodiment of FIG. 1, pilot valve 10 is arranged in parallel with power valve 8. More particularly, control slider member 20 of pilot valve 10 is biased in one direction by a spring 21 and is biased in the opposite direction by the fluid operating pressure of hydraulic pump 1 through control pipe 7 before the latter is transmitted through power valve 8. As with the aforementioned valves 8 and 9, slider member 20 of pilot valve 10 includes a transverse channel through which fluid at the connection of control pipe 7 and the output of valve 9 is supplied from an input pipe 22 thereof to a pressureless drain 32 when slider member 20 is positioned at switch setting a, as shown in FIG. 1. On the other hand, when slider member 20 is positioned at switch setting b thereof, slider member 20 prevents the output of valve 9 from being supplied to pressureless drain 32, as indicated by the inverted-T section at the upper end and the T-section at the lower end of slider member 20 for switch setting b.

In operation, for the starting and idling states of hydraulic pump 1, since virtually no fluid operating pressure exists in control pipe 7, and thereby in control space 6, spring 12 biases piston 3 to the left, as viewed in FIG. 1, so that hydraulic pump 1 is set to minimum flow volume $V_{min}$, that is, residual circulation volume. In other words, at such time, the pressure in operating pipe 2 is low, corresponding to low circulation flow of the operating fluid, which results in practically no adjustable fluid pressure being provided by control pipe 7 to control space 6. Also, at such time, since virtually no fluid pressure exists in pipe 15, slider member 14 of power valve 8 is biased by spring 16 to switch setting b as shown in FIG. 1. Also, at such time, slider member 17 of valve 9 is biased to switch setting a, as shown in FIG. 1, by spring 18 since no pressure exists in pipe 19 which branches off from control pipe 7. Further, slider member 20 of pilot valve 10 is biased to switch setting a thereof by spring 21 because of the lack of pressure in control pipe 7. As a result, any fluid pressure from control pipe 7 which is transmitted through valves 8 and 9 is connected with pressureless drain 32 through slider member 20 so that no pressure is supplied to control space 6 from control pipe 7.

When a load is connected to operating pipe 2, the fluid operating pressure in the latter increases. Accordingly, slider member 20 of pilot valve 10 is biased by the increasing control pressure in control pipe 7 against the force of spring 21 to move slider member 20 to switch setting b so that the output of valve 9 is not connected to pressureless drain 32. At such time, while pressure is building up in control pipe 7, fluid is transmitted through valves 8 and 9 and control pipe 7 at the output thereof to control space 6 to provide an increasing adjustable fluid pressure for piston 3. Accordingly, piston 3 is shifted to the right, as viewed in FIG. 1, and hydraulic pump 1 is thereby set for maximum flow volume $V_{max}$. In other words, the magnitude of the adjustable force (pressure time area) against piston end face 4 is greater than the magnitude of the force resulting from the same presssure against piston end face 5 plus the force from springs 12 and 13. This occurs because end face 4 is provided with a larger diameter than end face 5. It is to be appreciated, however, that, at such time, the force of spring 16 is greater than the force of measuring spring 13 plus the force of the operating fluid pressure from pipe 15 which branches off from control pipe 7, and accordingly, slider member 14 remains at switch setting b.

Power regulation is active when pressure of the operating fluid in operating pipe 2, and therefore, in control pipe 7, exceeds a predetermined value. At such time, slider member 14 of power valve 8 is biased to switch setting a by the additional control pressure in pipe 15. As a result, fluid is not transmitted from control pipe 7 through output pipe 29, but rather, output pipe 29 is connected to pressureless drain 32. In such case, the adjustable fluid pressure in control pipe 7 which is connected after valves 8 and 9, and the adjustable pressure in control space 6, is drained to pressureless drain 32, resulting in piston 3 moving to the left, as viewed in FIG. 1, to shift hydraulic pump 1 in the direction of lower fluid flow. It is to be appreciated that this type of power regulation corresponds to typical power regulation with the special condition that for increasing power greater than a predetermined level, and with decreasing adjustable pressure in control pipe 7 and control space 6, power loss of hydraulic pump 1 increases. This is contrary to the aforementioned arrangement in which, for increasing power greater than a predetermined level, the hydraulic pump operates with increased adjustable pressure. At such time, pilot valve 10 remains at switch setting b.

In addition to the aforementioned power regulation by power valve 8, pressure regulation occurs through slider member 17 of pressure valve 9. More particularly, due to the increasing pressure in pipe 19 which branches off from control pipe 7 before valves 8 and 9, slider member 17 is biased into switch setting b so that control pipe 7 connected after valves 8 and 9, and thereby control space 6, are connected with pressureless drain 32, whereby adjustable piston 3 moves to the left, as viewed in FIG. 1, and hydraulic pump 1 is set at a minimum discharge volume $V_{min}$. At such time, slider member 14 of power valve 8 remains at switch setting a.

Thus, in accordance with the present invention, pilot valve 10 provides for a cut-off of the adjusting pressure to piston 3 in the no-load and idling states of hydraulic pump 1. In such conditions, pilot valve 10 drains the fluid transmitted through valves 8 and 9 to prevent a pressure build-up in control space 6. With such arrangement, cold starting without damage to hydraulic pump 1 is made possible since the pump will not immediately start with full volume flow, that is, the rotational power of hydraulic pump 1 will drop to a minimum value. This is because the power regulating device according to the present invention has a switching function, that is, valve 10, that cuts off the power regulation operation when the power generated by hydraulic pump falls below a predetermined minimum power level and, at such time, resets hydraulic pump 1 for a minimum discharge operation. In the embodiment of FIG. 1 described above, the pilot valve 10 which performs this switching function is positioned parallel to power valve 8.

As should also be appreciated from the above description of one embodiment of the present invention, the operating fluid through pipe 15 acts in the same direction on slider member 14 as measuring spring 13. Thus, when power is increased above a predetermined level, slider member 14 is biased to switch setting a so that hydraulic pump 1 is operated at a lower capacity and has a dropping adjustable fluid pressure acting on piston 3. This is contrary to the aforementioned previously-proposed arrangement in which, for power greater than a predetermined level, the adjustable pressure acting on piston 3 increases.

It is to be appreciated that, with the present arrangement, end face 4 of piston 3 is larger than end face 5 thereof. With such arrangement, resetting of hydraulic pump 1 for low discharge is readily controlled by the adjustable pressure at end face 4 if the power consumption of hydraulic pump 1 is greater than a first predetermined level or falls below a second, lower predetermined level, that is, corresponding to start-up or idling of hydraulic pump 1.

Figure 2:
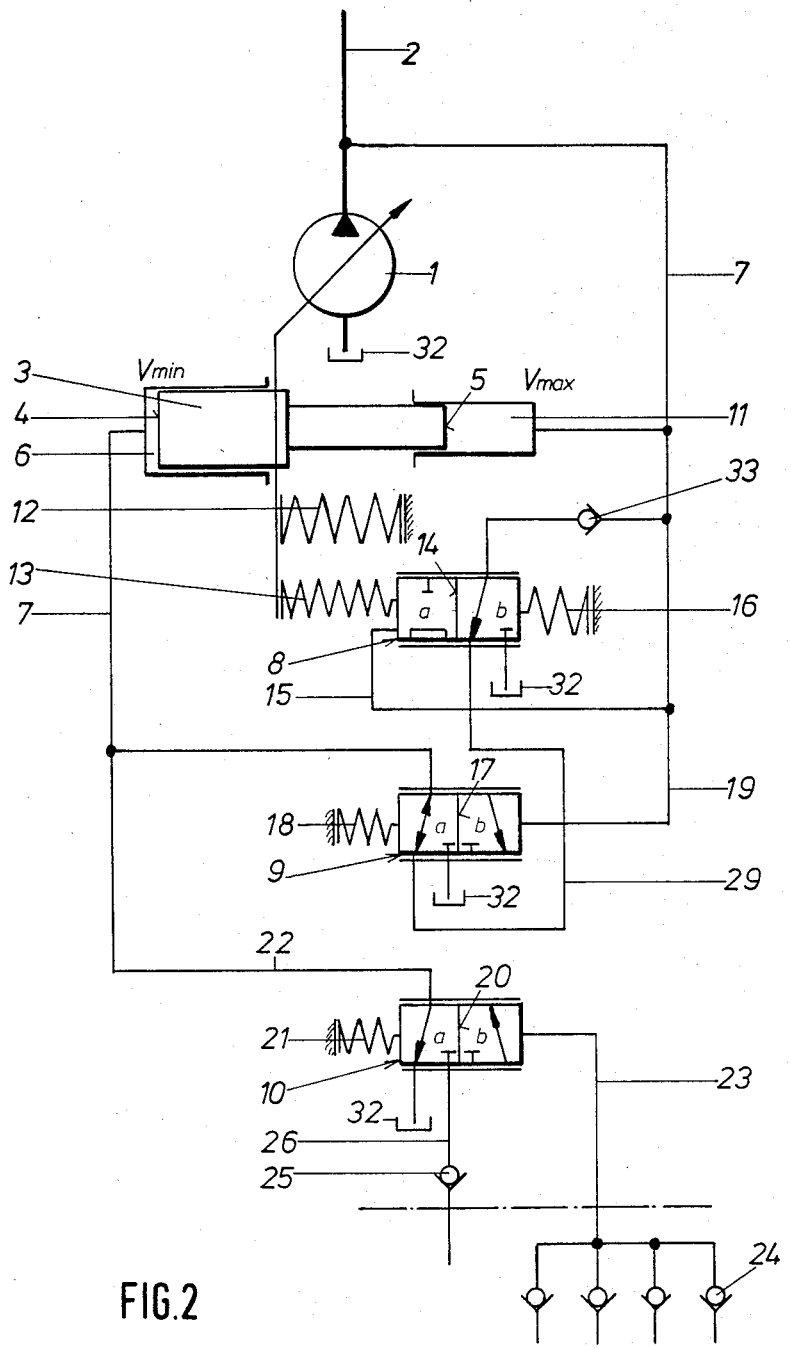
FIG. 2 is a schematic diagram of a power regulation device for a hydraulic pump according to a second embodiment of the present invention.

Referring now to FIG. 2, a power regulation device for a hydraulic pump according to a second embodiment of the present invention is shown in which elements corresponding to those previously-described with respect to the first embodiment of FIG. 1 are identified by the same reference numerals, and a detailed description thereof will be omitted herein for the sake of brevity. In the embodiment of FIG. 2, slider member 20 of pilot valve 10 is biased in a first direction by spring 21 and, in the opposite direction by fluid pressure in a pipe 23 which is supplied with a variable control pressure through respective valves 24. In the embodiment of FIG. 2, four valves 24 are shown by way of example, although it is to be appreciated that more or less valves may be connected. The inflow side of slider member 20 which is connected through pipe 22 to the output of slider member 17, is adapted to be connected to pressureless drain 32 (switch setting a) or a reset back-pressure valve 25 (switch setting b) through a pipe 26 with a constant control pressure from a device connected to hydraulic pump 1. In addition, a reset back-pressure valve 33 is provided between control pipe 7 and the input of power valve 8.

In operation, during the starting and idling phases of hydraulic pump 1, piston 3 is biased by the force of spring 12 to the left, as viewed in FIG. 2, so that hydraulic pump 1 is set for minimum discharge volume $V_{min}$. At such time, slider member 14 of power valve 8 is biased by spring 16 to switch setting b, as indicated in FIG. 2, and slider member 17 is biased by spring 18 to switch setting a, as also indicated in FIG. 2. Accordingly, at such time, control pipe 7 at the input of valves 8 and 9 is in fluid communication with control space 6. However, at such time, slider member 20 of pilot valve 10 is biased by spring 21 to switch setting a so that the output of valve 9, and thereby control pipe 7 thereat and control space 6, are connected with pressureless drain 32, as indicated in FIG. 2. When a load is connected to operating pipe 2 so that the fluid pressure increases, a variable control pressure of a load connected to hydraulic pump 1 acts through valves 24 and pipe 23 on slider member 20 of pilot valve 10 to move the latter to switch setting b. As a result, control pipe 7 at the output end of valves 8 and 9 is connected through slider member 20 so that a constant control pressure of a connected load is supplied through reset valve 25 and pipe 26 to control pipe 7 and control space 6, whereby piston 3 is biased to the right, as viewed in FIG. 2, and hydraulic pump 1 is set for maximum discharge volume $V_{max}$. It is to be appreciated that, during normal operation when the fluid operating pressure in operating pipe 2 is below a sensitivity value, slider members 14 and 17 are maintained at switch settings b and a, respectively. If, during operation, the fluid operating pressure in pipe 2, and consequently, the control pressure in pipe 7, is higher than the constant control pressure existing in pipe 26, reset valve 25 closes, with switch settings of valves 8, 9 and 10 being maintained. Accordingly, it is to be appreciated that, in such case, the adjustable pressure in control space 6 is controlled by fluid flow through reset valve 33. Accordingly, in the embodiment of FIG. 2, the constant control pressure of the load connected to hydraulic pump 1 is used only for performing the switching function of piston 3 from the $V_{min}$ to the $V_{max}$ setting. In the case where the operating pressure exceeds that in pipe 26 so that pilot valve 10 is disconnected from the system, the power regulating device of FIG. 2 then operates in an identical manner to the power regulating device of FIG. 1. It is to be appreciated that, in the embodiment of FIG. 2, the switching function of pilot valve 10 is not released by the pressure of the operating fluid as with the first embodiment.

Figure 3:
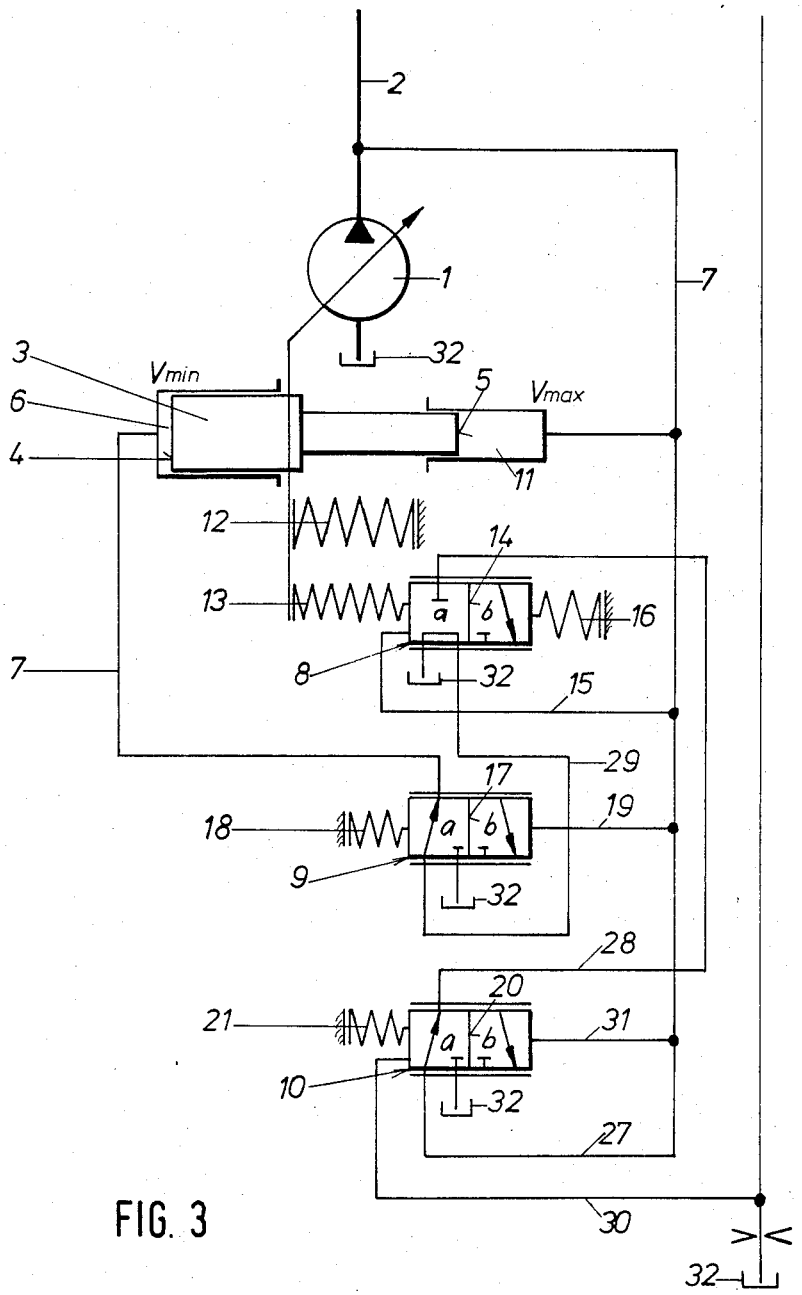
FIG. 3 is a schematic diagram of a power regulation device for a hydraulic pump according to a third embodiment of the present invention.

Referring now to FIG. 3, a third embodiment of a pressure regulation device for a hydraulic pump according to the present invention is shown in which elements corresponding to those previously described with respect to the embodiments of FIGS. 1 and 2 are identified by the same reference numerals, and a detailed description thereof will be omitted herein for the sake of brevity. In the embodiment of FIG. 3, pilot valve 10 is connected before power valve 8 and pressure valve 9, that is, control pipe 7 which is connected to operating pipe 2 of hydraulic pump 1 is connected through an input pipe 27 at the inflow side of pilot valve 10, and the outflow side of pilot valve 10 is connected through an output pipe 28 to the inflow side of power valve 8. Slider member 20 of pilot valve 10 is biased in one direction by spring 21, and also, by a load pressure of a load driven by hydraulic pump 1 through a pipe 30. Slider member 20 is biased in the opposite direction by fluid pressure in a pipe 31 which is connected to control pipe 7 at the input side of valves 8 and 9.

In operation, during the start-up and idling phases of hydraulic pump 1, piston 3 is biased to the left, as viewed in FIG. 3, by springs 12 and 13 so that hydraulic pump 1 is set for minimum discharge volume $V_{min}$. At such time, slider member 20 of pilot valve 10 is biased by spring 21 to switch setting b so that outflow pipe 28 thereof is connected to pressureless drain 32. Further, at such time, slider member 14 of power valve 8 is biased by spring 16 to switch setting b and slider member 17 is biased by spring 18 to switch setting a. Accordingly, control pipe 7 at the output of pressure valve 9, and therefore, control space 6, are connected to pressureless drain 32. In such case, as previously discussed, piston 3 is shifted to the left, as viewed in FIG. 3, by spring 12 for minimum flow volume $V_{min}$.

During operation in the load state, but below the sensitivity level for power regulation, the load pressure is transmitted through pipe 30 to slider member 20 of pilot valve 10 to bias the latter into switch setting a, as shown in FIG. 3. At such time, slider members 14 and 17 are maintained in switch settings b and a, respectively. Accordingly, fluid pressure is transmitted from control pipe 7 through input pipe 27 of valve 10 and then through valves 8 and 9 to control space 6 to bias piston 3 to the right, as viewed in FIG. 3, for maximum flow volume $V_{max}$. Thereafter, the embodiment of FIG. 3 operates in the same manner as previously described with respect to the embodiment of FIG. 1. It is to be appreciated that, in this embodiment, slider member 20 is set in response to a predetermined difference between the pressure of the operating fluid and the load pressure through pipe 30.

It is to be noted that, in the first embodiment, slider member 20 is controlled by the magnitude of the fluid operating pressure supplied by hydraulic pump 1; in the second embodiment by the magnitude of an external control pressure; and in the third embodiment, by the difference between the fluid operating pressure and the pressure of a load on the pump.

It is to be appreciated that various changes and modifications can be made by one of ordinary skill in the art within the scope of this invention. For example, a valve for cutting off the fluid pressure can be connected in control pipe 7 to power valve 8, so that the valve is biased on one side by a spring and, on the other side, by fluid operating pressure, to drain the fluid for a given maximum pressure of the operating fluid.

Having described specific preferred embodiments of the invention with reference to the accompanying drawings, it is to be understood that the present invention is not limited to these embodiments and that various changes and modifications may be effected therein by one of ordinary skill in the art without departing from the scope and spirit of the invention as defined by the appended claims.

What is claimed is:

1. In a power regulation device for a hydraulic pump which generates a pump pressure for producing an adjustable discharge of a working fluid supplied to a load, said device comprising:

measuring spring means;

power valve means including control slider means connected to said measuring spring means;

adjustable hydraulic means including slidable piston means connected to said pump, the position of said slidable piston means controlling said discharge and said slidable piston means being biased in one direction by an adjustable fluid pressure and in an opposite direction by said measuring spring means, said measuring spring means also biasing said control slider means in a given direction, said power valve means controlling said adjustable fluid pressure acting upon said slidable piston means, and said control slider means being biased in said given direction by said pump pressure; and pilot valve means for adjusting the regulating device towards a condition for zero pump discharge;

the improvement wherein:

said device further comprises power spring means biasing said control slider means in a direction opposite said given direction, thus opposing the bias exerted on said control slider means by said measuring spring means;

adjustment of the regulating device towards a condition for reduced pump discharge is effected by reducing said adjustable fluid pressure acting on said slidable piston means; and said pilot valve means reduces said adjustable fluid pressure acting on said slidable piston means substantially to zero during a no-load condition of said pump.

2. A device according to claim 1; further comprising adjustable spring means acting upon said slidable piston means and arranged in parallel with said measuring spring means, said adjustable spring means biasing said slidable piston means towards a condition for reduced pump discharge.

3. A device according to claim 2; wherein said slidable piston means is formed with a first piston surface which is exposed to said adjustable fluid pressure and with a second piston surface which is smaller than said first surface and is exposed to said pump pressure, said adjustable fluid pressure and pump pressure generating opposing forces respectively acting on said surfaces.

4. A device according to claim 1; wherein said pilot valve means is biased in a first direction by said pump pressure, further comprising pilot valve spring means biasing said pilot valve means in a second direction opposite said first direction.

5. A device according to claim 1; wherein said working fluid is returned from said load at load pressure and said pilot valve means is biased in a first direction by said load pressure, further comprising pilot valve spring means biasing said pilot valve means in a second direction opposite said first direction.

6. A device according to claim 1; wherein said working fluid is returned from said load at load pressure and said pilot valve means is biased in a first direction by said pump pressure and in a second direction opposite said first direction by said load pressure, further comprising pilot valve spring means biasing said pilot valve means in said second direction, said adjustable fluid pressure being supplied to said slidable piston means via said pilot valve means and said power valve means, said pilot valve means responding to the difference between said pump pressure and said load pressure exceeding a predetermined threshold by reducing said adjustable fluid pressure acting on said slidable piston means substantially to zero.

* * * * *